US006091057A

United States Patent [19]

Asami et al.

[11] Patent Number: 6,091,057

[45] Date of Patent: Jul. 18, 2000

[54] BROILER OVEN

[75] Inventors: Shinji Asami, Matsubara; Yasuhiro Sakoda, Wakayama; Yuzi Andoh, Yamatokoriyama; Tetsuichi Arita, Kawachinagano, all of Japan

[73] Assignee: Sharp Kabushiki Kaisha, Osaka, Japan

[21] Appl. No.: 09/320,690

[22] Filed: May 27, 1999

[30] Foreign Application Priority Data

Jun. 16, 1998 [JP] Japan ..... 10-168014

[51] Int. Cl.[7] ..... H05B 6/80

[52] U.S. Cl. ..... 219/404; 219/685; 219/704; 219/708; 99/325

[58] Field of Search ..... 219/685, 702, 219/704, 404, 754, 708; 99/325

[56] References Cited

U.S. PATENT DOCUMENTS

| | | | |
|---|---|---|---|
| 3,281,575 | 10/1966 | Ferguson, Jr. | 219/404 |
| 4,596,914 | 6/1986 | Morino | 219/685 |
| 5,534,681 | 7/1996 | Hwang | 219/685 |
| 5,548,102 | 8/1996 | Kwon . | |

FOREIGN PATENT DOCUMENTS

| | | |
|---|---|---|
| 3135290A1 | 3/1983 | Germany . |
| 60-108907 | 7/1985 | Japan . |
| 3-67931 | 3/1991 | Japan . |
| 3-144218 | 6/1991 | Japan . |
| 4-97206 | 8/1992 | Japan . |
| 9-79589 | 3/1997 | Japan . |

*Primary Examiner*—Philip H. Leung

[57] ABSTRACT

A broiler oven has a heating chamber 2, first and second movable heaters 61 and 62 formed out of tubular heaters and rotatably supported by the inner walls of the heating chamber 2 in such a way that their heating portions 61*b* and 62*b* and their shaft portions 61*a* and 62*a* joined together so as to be parallel to each other by their arm portions 61*c* and 62*c* are held at an equal level, a driving mechanism 12 for rotating the shaft portions 61*a* and 62*a*, and a control circuit 10 for controlling the first and second movable heaters 61 and 62 and the driving mechanism 12. The control circuit 10 controls the driving mechanism 12 to rotate the first and second movable heaters 61 and 62 between a non-heating position and a heating position, and energizes the first and second movable heaters 61 and 62 when they are in the heating positions.

14 Claims, 11 Drawing Sheets

BROILER OVEN

BACKGROUND OF THE INVENTION

1. Field of the Invention

The present invention relates to an improvement in a oven having a broiler type heater element.

2. Description of the Prior Art

A conventional broiler oven is known that has a structure as shown in FIG. 15. This oven cooks food to be cooked 8 placed on a turntable 5 by applying thereto microwaves produced by a magnetron (not shown) within a heating chamber 2 provided inside a cabinet 1 openable with a door 1*a*, or heat radiated from an upper fixed heater 3 provided in the ceiling 2*a* of the heating chamber 2 and from a lower fixed heater 4 provided in the floor 2*b* of the heating chamber 2. Another conventional broiler oven is known that has a structure as shown in FIG. 16. This oven has, instead of the upper fixed heater 3 of the above conventional broiler oven, a movable heater 6, formed out of a tubular heater, in the upper portion of the heating chamber 2, so that, when food to be cooked 8 placed on the turntable 5 is cooked, heat can be applied thereto with the movable heater 6 rotated downward.

As shown in FIG. 17, the movable heater 6 of the latter conventional broiler oven is formed, as a whole, to have a U-shaped horizontal section. The two open-side ends of the movable heater 6 are both bent outward so as to form a shaft portion 6*a*, and are rotatably supported by the upper portion of the side walls of the heating chamber 2. The free, closed-side portion of the movable heater 6 is formed in a shape of a series of alternating U-shaped turns so as to form a heating portion 6*b*. To this heating portion 6*b*, a reflecting plate 7 (see FIG. 16) is attached so that the heat radiated from the heating portion 6*b* will be reflected efficiently toward the food to be cooked 8.

Moreover, the movable heater 6 of the latter conventional broiler oven has its shaft portion 6*a* driven by a driving mechanism 12 provided on the outer surface of the upper portion of either of the side walls of the heating chamber 2. In accordance with how data entry keys 9 provided on an operation panel are operated, a control circuit 10 controls the driving mechanism 12 to rotate the movable heater 6 between a resting (non-heating) position indicated by solid lines in FIG. 16 and a heating position indicated by broken lines.

In a broiler oven having a heater, it is customary to use a grill as shown in FIG. 18 as a cooking rack. Such a grill 11 is composed of a frame 11*a* made by forming a metal or other wire into a flat rectangular, and a plurality of parallel metal or other beams 11*b* fitted thereto uniformly from above or below at regular intervals so as to bridge between the two longer sides of the rectangular. As shown in FIGS. 19 and 20, the grill 11 is placed on grill brackets 2*c* provided on the inner surfaces of the side walls 2*e* of the heating chamber 2, and is used for oven-like heating with food to be cooked 8, such as a slice of bread to be toasted or a piece of frozen pizza to be thawed, placed on the grill 11.

However, in the broiler oven shown in FIG. 15, the upper fixed heater 3 is placed too far away from the food to be cooked 8, and thus heating the food 8 as desired requires too much time. On the other hand, in the broiler oven shown in FIG. 16, when the movable heater 6 is rotated to the heating position so as to be brought closer to the food to be cooked 8, its heating portion 6*b*, which is flat, is inevitably held in a inclined posture with respect to the food 8, and this leads to uneven cooking of the food 8.

Moreover, when the grill 11 is used, the food to be cooked 8 may be placed at different levels depending on whether the grill 11 is placed on the grill brackets 2*c* of the heating chamber 2 with the beams 11*b* located above the frame 11*a* as shown in FIG. 19 or with the beams 11*b* located below the frame 11*a* as shown in FIG. 20. This causes variation in the distance from the heater to the food 8, and thus leads to uneven cooking of the food 8.

SUMMARY OF THE INVENTION

An object of the present invention is to provide a broiler oven that makes it possible to reduce cooking time and minimize uneven cooking.

To achieve the above object, according to one aspect of the present invention, a broiler oven is provided with: a heating chamber for accommodating food to be cooked; a plurality of tubular heaters arranged inside the heating chamber and each having a shaft portion, a heating portion parallel to the shaft portion, and an arm portion joining the shaft portion and the heating portion together; a common driver for rotating the tubular heaters; and a controller for controlling the heat generated by the tubular heaters. Here, the tubular heaters are each rotatable about their respective shaft portion so as to be moved between a resting position and a heating position, the tubular heaters are arranged with their shaft portions supported parallel to one another at an equal level, and the tubular heaters have their arm portions made equally long mutually overlapping. The oven is further provided with a linker for interlocking the rotation of the tubular heaters so as to keep the distances between their heating portions constant.

In this broiler oven, the shaft portions of the tubular heaters are held parallel to one another at an equal level, their arm portions have an equal length and are mutually overlapping, and the distances between their heating portions are kept constant. Accordingly, the heating portions of all the tubular heaters are kept at an equal level irrespective of whether they are in the resting or heating position. This makes it possible to heat evenly the food to be cooked accommodated horizontally in the heating chamber.

It is possible to design the driver to serve also as the linker. Alternatively, it is possible to fit a reflecting plate to the tubular heaters so as to be rotatable with respect to each of the tubular heaters, and use this reflecting plate as the linker.

When there are provided two of the tubular heaters, the tubular heaters may be each bent near a center of their respective arm portion and arranged with their bends pointing in opposite directions in such a way that, when the tubular heaters are in the resting position, the shaft portion of the first tubular heater is located near the bend of the arm portion of the second tubular heater and the heating-portion-side portion of the arm portion of the second tubular heater is located near the bend of the arm portion of the first tubular heater, with the shaft portions and the heating portions of the two tubular heaters held substantially at an equal level.

In this structure, it is possible to keep the heating portions of the two tubular heaters always at an equal level and simultaneously reduce the space occupied by the tubular heaters when they are in the resting position. Moreover, it is possible to realize the two tubular heaters by the use of tubular heaters having the same specifications.

According to another aspect of the present invention, a broiler oven is provided with: a heating chamber for accommodating food to be cooked; a fixed heater provided on the ceiling of the heating chamber; a movable heater having a shaft portion supported in a portion of the heating chamber near the ceiling thereof and a heating portion rotatable about the shaft portion; a driver for rotating the movable heater; and a controller for controlling heat generated by the fixed heater and the movable heater. Here, the heating portion of the movable heater is rotatable through 180 degrees between a resting position opposite to the fixed heater with respect to the shaft portion and a heating position facing the fixed heater. The broiler oven is further provided with a supporter for supporting a cooking rack in a position between the fixed heater and the heating position of the movable heater.

In this broiler oven, it is possible to heat the food to be cooked placed on the cooking rack from both above and below by the use of the fixed heater and the movable heater. In addition, by retracting the movable heater when it is not used, it is possible to make effective use of the space inside the heating chamber.

It is possible to make the cooking rack removable from the supporter. In that case, the cooking rack is preferably composed of a frame that is supported on the supporter at both ends thereof and a plurality of beams that are fixed to the frame uniformly from above or below, with the beams made equally thick and arranged on the frame except at and near both ends thereof. Here, the frame is preferably bent near both ends thereof in the direction from which the beams are fixed thereto in such a way that the centers of thickness of both ends of the frame and the centers of thickness of the beams all lie on a single plane.

In this structure, where the bottom end of the food to be cooked is kept at an equal level irrespective of whether the cooking rack is placed with its beams located above or below its frame, it is possible to prevent the heat applied from varying according to how the cooking rack is placed.

BRIEF DESCRIPTION OF THE DRAWINGS

This and other objects and features of the present invention will become clear from the following description, taken in conjunction with the preferred embodiments with reference to the accompanied drawings in which.

DESCRIPTION OF THE PREFERRED EMBODIMENTS

Hereinafter, embodiments of the present invention will be described with reference to the drawings. For simplicity's sake, such components as are found also in a conventional broiler oven described earlier are identified with the same reference numbers.

Figure 1:
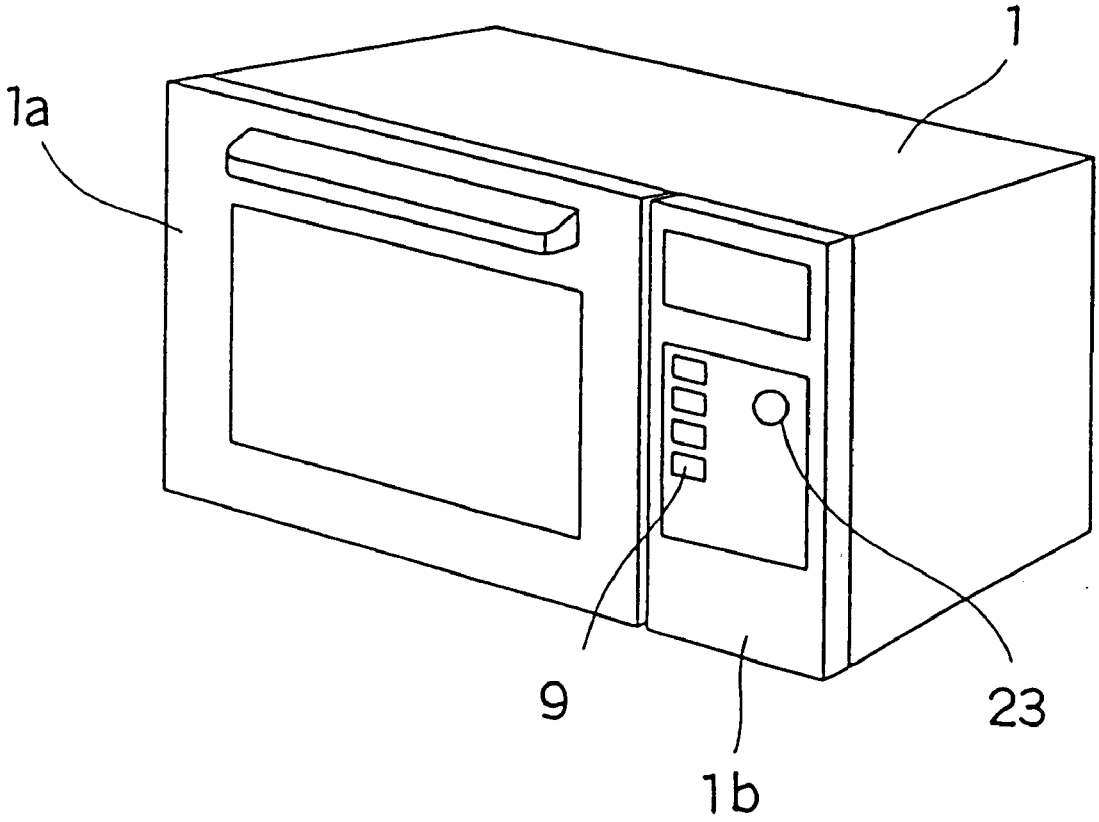
FIG. 1 is a perspective view showing the appearance of the a broiler oven of a first embodiment of the invention.
Figure 2:
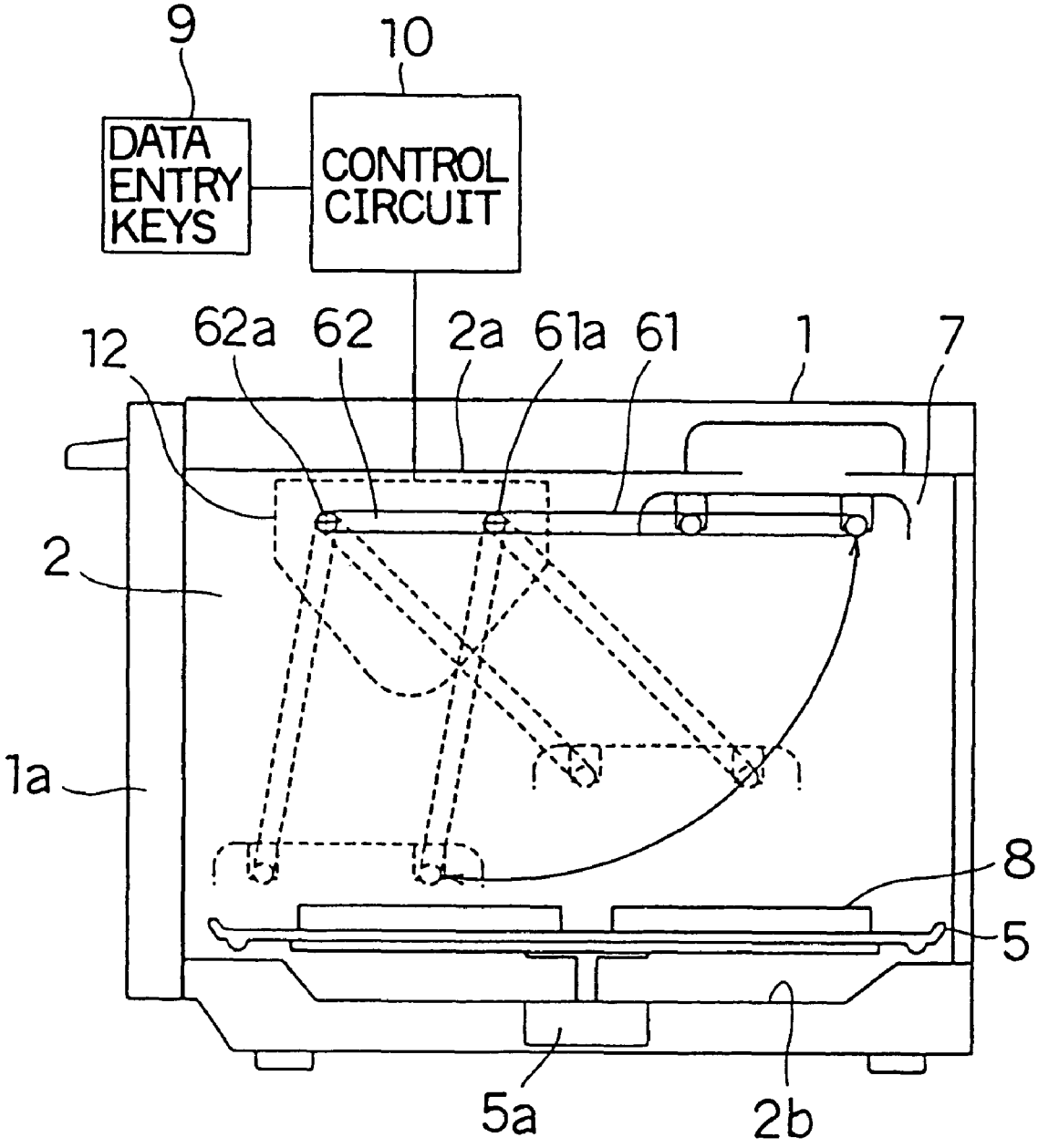
FIG. 2 is a schematic sectional view, as seen from the side, of the broiler oven of the first embodiment.

FIG. 1 is a perspective view showing the appearance of the a broiler oven of a first embodiment of the invention, and FIG. 2 is a schematic sectional view, as seen from the side, of the same oven. As shown in these figures, the broiler oven has a cabinet 1 having a heating chamber 2 formed inside it that is openable with a door 1*a*. The cabinet 1 has, on its front surface, an operation panel 1*b* on which various data entry operations related to how the food to be cooked is to be heated are performed.

Figure 3:
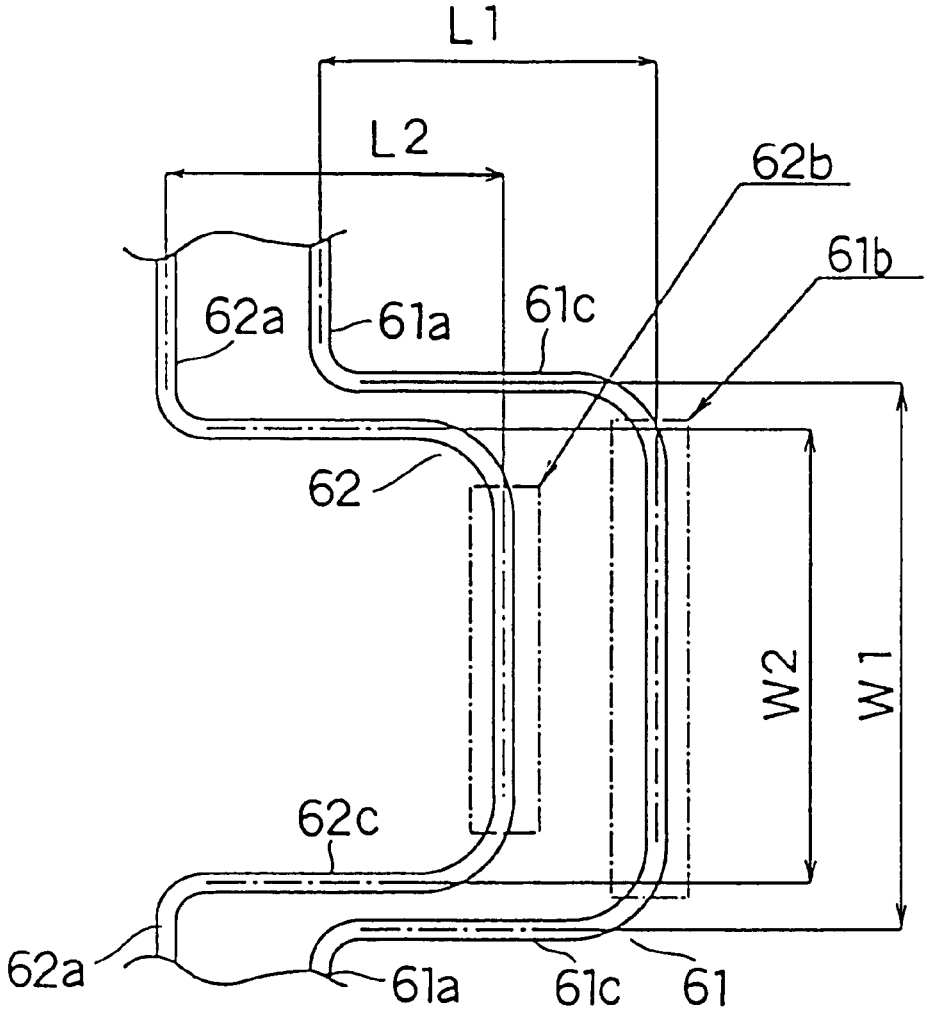
FIG. 3 is a plan view of the principal portion of the first and second movable heaters used in the broiler oven of the first embodiment.
Figure 4:
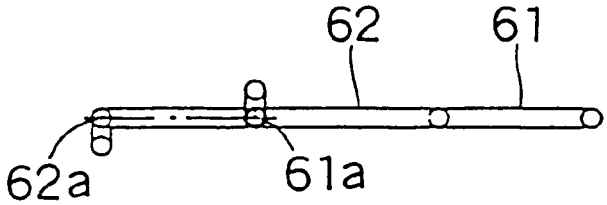
FIG. 4 is a side view of the first and second movable heaters used in the broiler oven of the first embodiment.

In the bottom portion of the heating chamber 2 is provided a turntable 5, which is driven by a turntable motor 5*a*. Reference numerals 61 and 62 represent a first and a second movable heater, of which each is formed out of a tubular heater to have a substantially U-shaped horizontal section. As shown in FIGS. 3 and 4, the first and second movable heaters 61 and 62 each have their two open-side ends bent outward so as to be formed into shaft portions 61*a* and 62*a*, and have heating portions 61*b* and 62*b* in their free, closed-side portion.

Moreover, the distance W1 between the arm portions 61*c* and 61*c* of the first movable heater 61 is made larger than the distance W2 between the arm portions 62*c* and 62*c* of the second movable heater 62, and the length L1 of the arm portions of the first movable heater 61 is made equal to the length L2 of the arm portions of the second movable heater 2. The shaft portions 61*a* and 62*a* are arranged parallel to each other at an equal level with a predetermined interval between them in such a way that the second movable heater 62 is placed in the open space between the arm portions 61*c* and 61*c* of the first movable heater 61. The shaft portions 61*a* and 62*a* are rotatably supported by a driving mechanism 12 provided on the outer surface of the upper portion of either of the side walls of the heating chamber 2.

Figure 5:
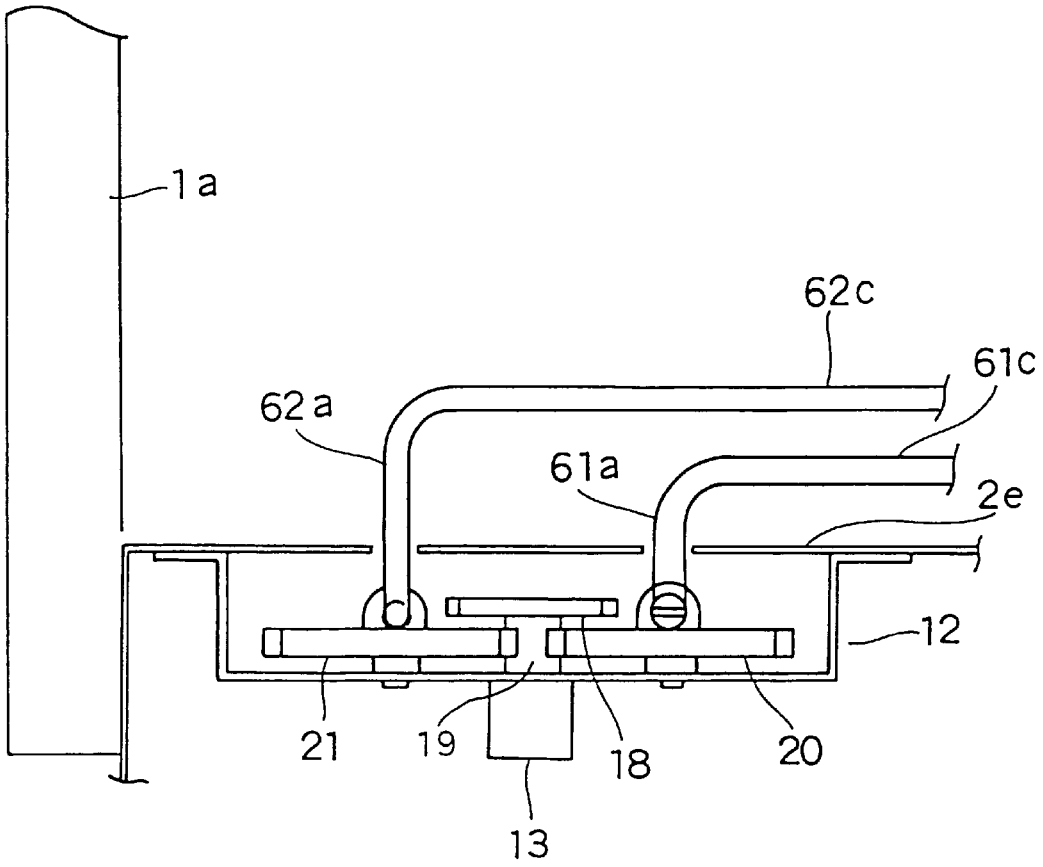
FIG. 5 is a schematic top view of the driving mechanism used in the broiler oven of the first embodiment.
Figure 6:
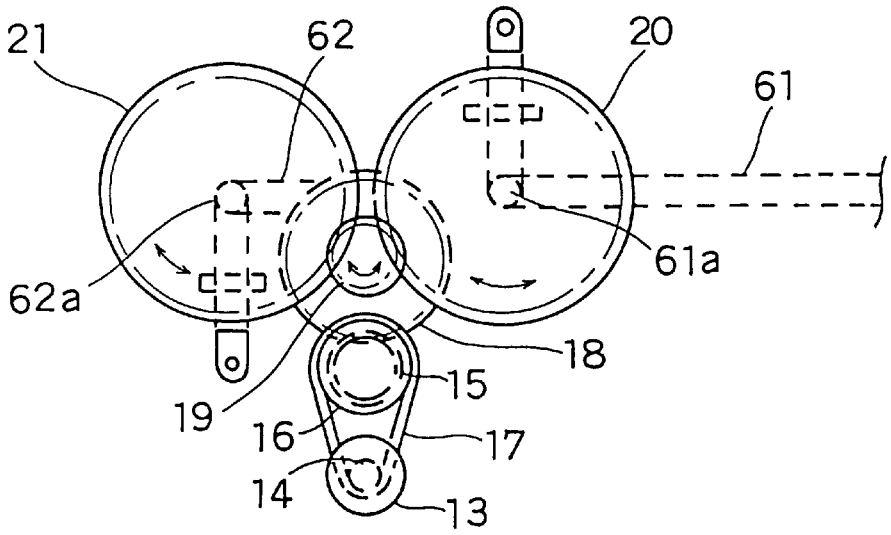
FIG. 6 is a side view of the driving mechanism used in the broiler oven of the first embodiment.

FIGS. 5 and 6 are a schematic plan view and a side view, respectively, of the driving mechanism 12. As shown in these figures, the driving mechanism 12 is composed of a motor 13, a pulley 14 fitted on the spindle of the motor 13, a first reduction gear 15, a pulley 16 coaxial with the first reduction gear 15, a belt 17 coupling the pulleys 16 and 14 together, a second reduction gear 18 meshed with the first reduction gear 15, a third reduction gear 19 coaxial with the second reduction gear 18, and a first and a second driving gear 20 and 21 meshed with the reduction gear 19 so as to support the ends of the shaft portions 61*a* and 62*a* of the first and second movable heaters 61 and 62.

In this structure, when the motor 13 rotates, its rotation force is transmitted through the pulley 14, the belt 17, the pulley 16, the first reduction gear 15, the second reduction gear 18, and the third reduction gear 19 to the driving gears 20 and 21, and thereby the shaft portions 61*a* and 62*a*, and thus the first and second movable heaters 61 and 62, are rotated synchronously.

When the first and second movable heaters 61 and 62 are rotated, their heating portions 61*b* and 62*b* move in such a way as to be kept at an equal level all the time. The heating portions 61*b* and 62*b* are fitted with a common reflecting plate 7 (FIG. 2). The reflecting plate 7 is rotatably fitted to the heating portions 61*b* and 62*b* in such a way as to be kept horizontal all the time when the first and second movable heaters 61 and 62 are rotated.

Figure 7:
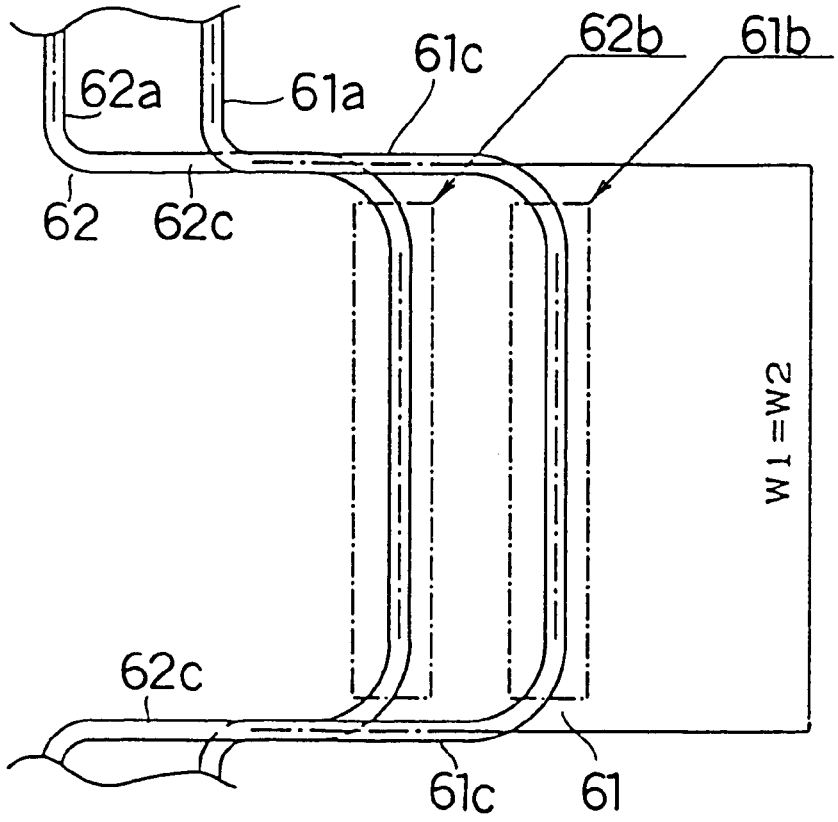
FIG. 7 is a plan view of the principal portion of another example of the first and second movable heaters for the broiler oven of the first embodiment.
Figure 8:
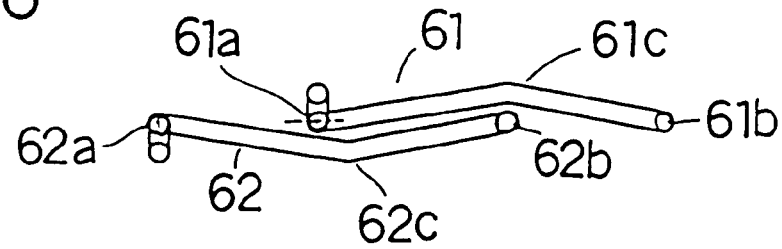
FIG. 8 is a side view of the first and second movable heaters shown in FIG. 7.

The motor 13 is driven under the control of the control circuit 10, and the control circuit 10 is fed with instructions in accordance with the operation of the data entry keys 9 provided on the operation panel 1*b*. FIGS. 7 and 8 show another example of the first and second movable heaters 61 and 62.

In this example, just as in the previously described example, the arm portions 61*c* and 62*c* of the first and second movable heaters 61 and 62 have an equal length and mutually overlap, and their shaft portions 61*a* and 62*a* are kept at an equal level. Moreover, the distance W1 between the arm portions 61*c* and 61*c* of the first movable heater 61 and the distance W2 between the arm portions 62*c* and 62*c* of the second movable heater 62 are equal.

In addition, in this example, to prevent the first and second movable heaters 61 and 62 from making contact with each other when they overlap with each other in the non-heating position, those portions of the first and second movable heaters 61 and 62 at which they overlap with each other are bent in opposite directions. This makes it possible to realize the first and second movable heaters 61 and 62 by the use of two components having the same specifications, and thereby reduce the total number of types of components needed.

In the broiler oven of the first embodiment having the structure as described above, cooking is performed in the following manner. First, when the first and second movable heaters 61 and 62 are in the non-heating position indicated by solid lines in FIG. 2, food to be cooked 8 is placed on the turntable 5. When, by operating the data entry keys 9 provided on the operation panel 1*b*, the heating mode and the heating time are specified, the turntable 5 starts rotating as the turntable motor 5*a* starts being driven.

Simultaneously, the motor 13 starts rotating under the control of the control circuit 10, and its rotation force is transmitted through the pulley 14, the belt 17, the pulley 16, the first reduction gear 15, the second reduction gear 18, and the third reduction gear 19 to the first and second driving gears 20 and 21. As a result, the first and second movable heaters 61 and 62 are rotated synchronously from the non-heating position to the heating position (indicated by broken lines in FIG. 2) closer to the food to be cooked 8 placed on the turntable 5.

Then, for the length of time specified from the data entry keys 9, the first and second movable heaters 61 and 62 are energized so that their heating portions 61*b* and 62*b* generate heat and thereby heat the food to be cooked 8. When the specified length of time elapses, the turntable 5 stops rotating. Then, the first and second movable heaters 61 and 62 are de-energized, the motor 13 is fed with a reversing signal and is thereby rotated in the reverse direction, and the first and second movable heaters 61 and 62, which have thus far been in the heating position, are retracted to the non-heating position. This is the end of a sequence of heating operations.

In this embodiment, it is possible to bring the heating portions 61*b* and 62*b* of the first and second movable heaters 61 and 62 as close to the food to be cooked 8 as is required by the height of the food 8 while keeping the heating portions 61*b* and 62*b* horizontal with respect to the turntable 5. This makes it possible to rotate the heating portions 61*b* and 62*b* between the non-heating and heating positions while keeping them at an equal level all the time, and thereby apply the radiated heat more evenly over the entire surface of the food to be cooked 8 accommodated inside the heating chamber 2.

Figure 9:
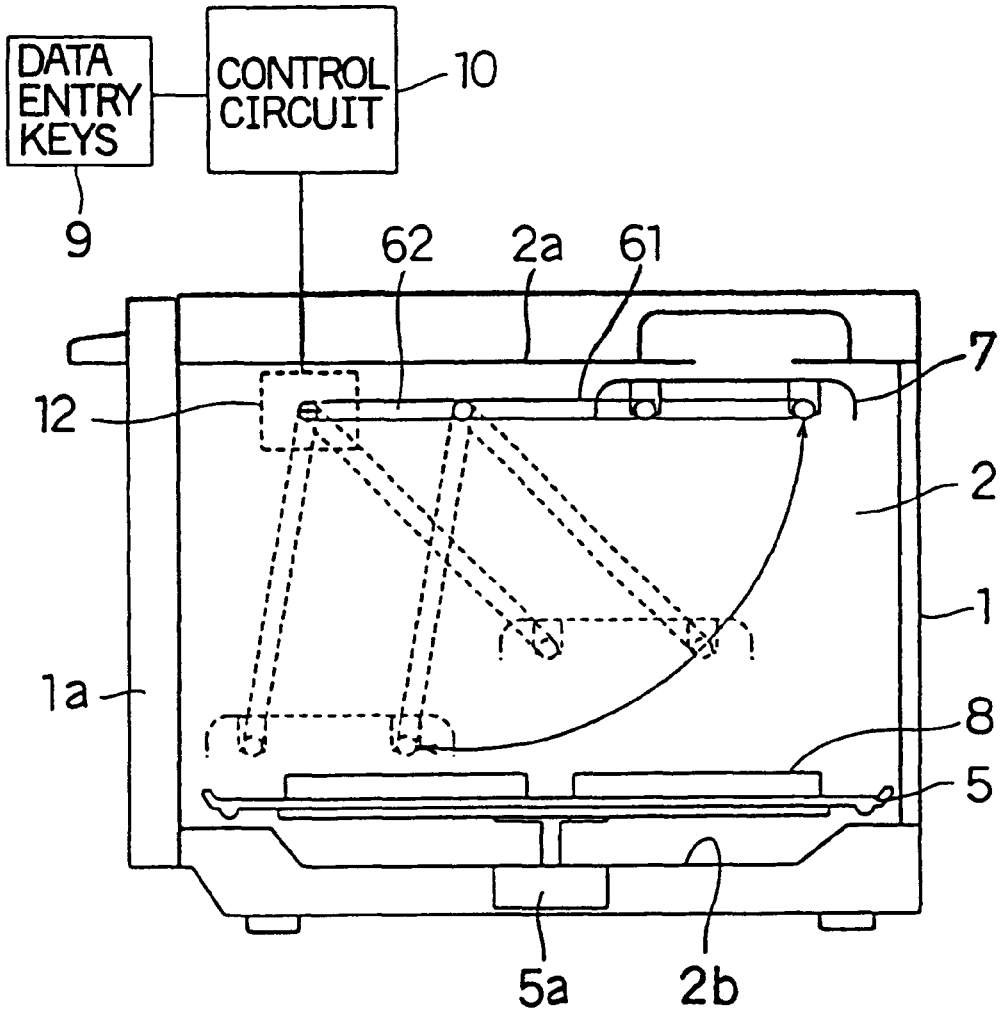
FIG. 9 is a schematic sectional view, as seen from the side, of the a broiler oven of a second embodiment of the invention.

FIG. 9 is a schematic sectional view, as seen from the side, of the broiler oven of the second embodiment of the invention. In this embodiment, as compared with the first embodiment described above, the first driving gear 20 is omitted from the driving mechanism 12. In this embodiment, the second driving gear 21 is linked only with the second movable heater 62, and the shaft portion 61*a* of the first movable heater 61 is rotatably fitted into holes formed in the inner surfaces of the side walls of the heating chamber 2. The first and second movable heaters 61 and 62 are linked together by the reflecting plate 7 that is rotatably supported by the first and second movable heaters 61 and 62. It is also possible to drive the first movable heater 61, instead of the second movable heater 62, directly by the motor 13.

In this structure, when the motor 13 is driven, the second driving gear 21 (see FIGS. 5 and 6) is rotated, and thereby the second movable heater 62 is rotated. This rotation is transmitted through the reflecting plate 7 to the first movable heater 61. As a result, the first movable heater 61, together with the second movable heater 62, is rotated from the non-heating position indicated by solid lines to the heating position indicated by broken lines.

Consequently, in this embodiment, just as in the first embodiment, it is possible to bring the heating portions 61*b* and 62*b* of the first and second movable heaters 61 and 62 as close to the food to be cooked 8 as is required by the height of the food 8 while keeping the heating portions 61*b* and 62*b* horizontal with respect to the turntable 5. This makes it possible to rotate the heating portions 61*b* and 62*b* between the non-heating and heating positions while keeping them at an equal level all the time, and thereby apply the radiated heat more evenly over the entire surface of the food to be cooked 8 accommodated inside the heating chamber 2. In addition, in this embodiment, the driving mechanism 12 has a simpler structure than in the first embodiment.

Figure 10:
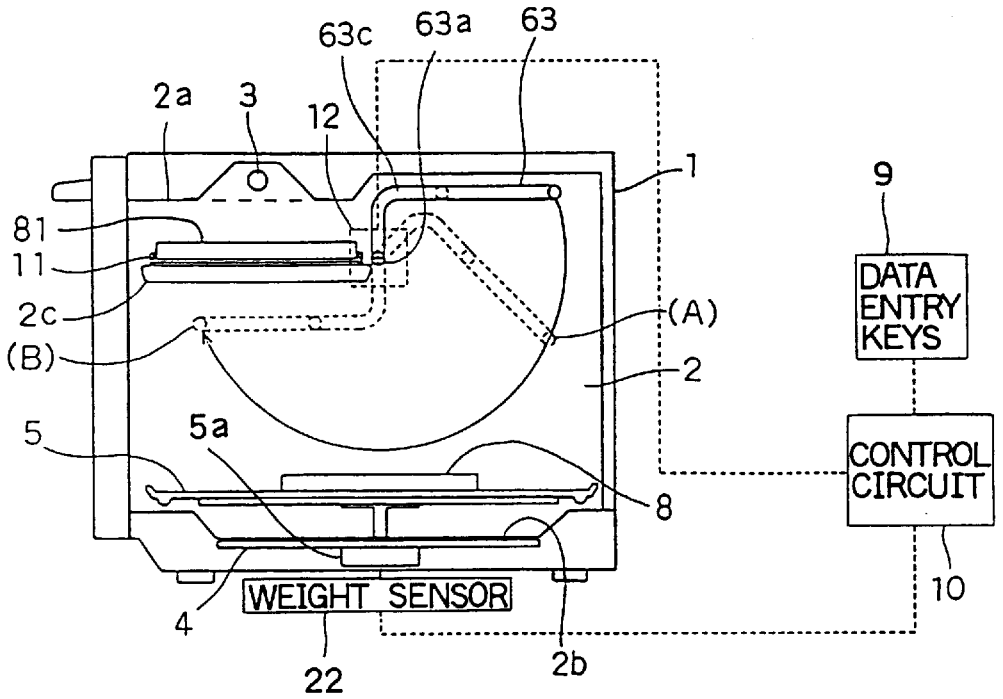
FIG. 10 is a schematic sectional view, as seen from the side, of the a broiler oven of a third embodiment of the invention.
Figure 11:
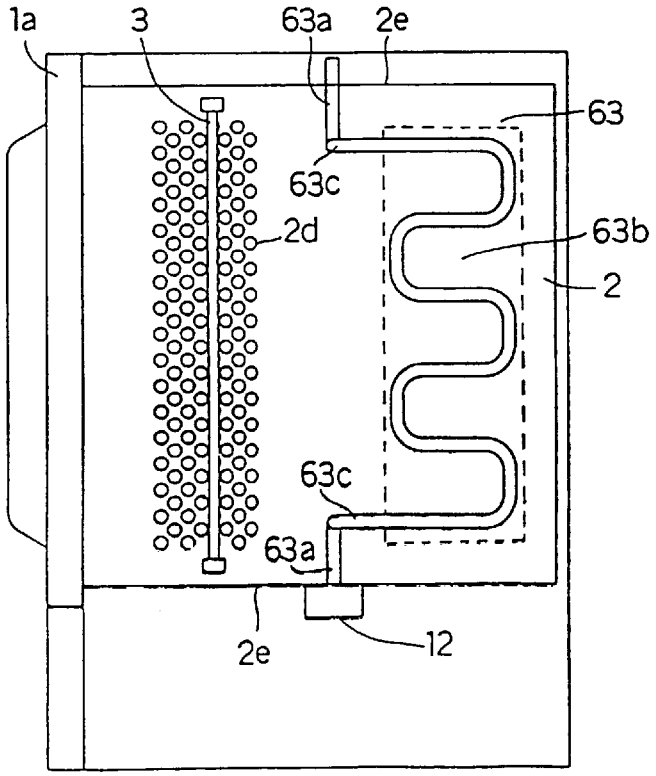
FIG. 11 is a schematic plan view showing the relationship between the upper fixed heater and the movable heater used in the broiler oven of the third embodiment.

FIGS. 10 and 11 are a schematic sectional view, as seen from the side, and a schematic top view, respectively, of the broiler oven of a third embodiment of the invention.

In this embodiment, an upper fixed heater 3 extending laterally across the heating chamber 2 formed inside the cabinet 1 is provided in the ceiling 2*a* of the heating chamber 2, near the door 1*a* to the heating chamber 2, and a lower fixed heater 4 is provided beneath the floor 2*b* of the heating chamber 2. Thus, the food to be cooked 8 placed on the turntable 5 is cooked by applying thereto heat radiated from the upper and lower fixed heaters 3 and 4. Reference numeral 2*d* represents small holes formed in that portion of the ceiling 2*a* of the heating chamber 2 which faces the upper fixed heater 3. These holes allow the heat radiated from the upper fixed heater 3 to be passed efficiently to the heating chamber 2.

Reference numeral 63 represents a movable heater that has, as shown in FIG. 11, a substantially U-shaped horizontal section. The movable heater 63 has its two open-side ends bent outward so as to be formed into shaft portions 63*a* and 63*a*, which are rotatably supported by the driving mechanism 12 provided on the outer surface of the upper central portion of either of the side walls of the heating chamber 2. The closed-side portion of the movable heater 63 is formed in a shape of a series of alternating U-shaped turns so as to serve as a heating portion 63*b*. When the movable heater 63 is seen from the side, its arm portion 63*c* is L-shaped so that its portion joining to the heating portion 63*b* extends horizontally and its portion joining to the shaft portion 63*a* extends vertically.

Although not clearly shown in FIGS. 10 and 11, in this embodiment, the driving mechanism 12 uses exactly the same structure as in the second embodiment to rotate the movable heater 63. The movable heater 63 is, at one end of its shaft portion 63*a*, rotatably fitted into a hole formed in the inner surface of either of the side walls of the heating chamber 2, and, at the other end of the shaft portion 63*a*, linked to the second driving gear 21 (see FIGS. 5 and 6). By driving the motor 13, the movable heater 63 can be rotated through 180 degrees from the non-heating position indicated by solid lines to the heating position indicated by broken lines (also indicated by (B)).

Figure 12:
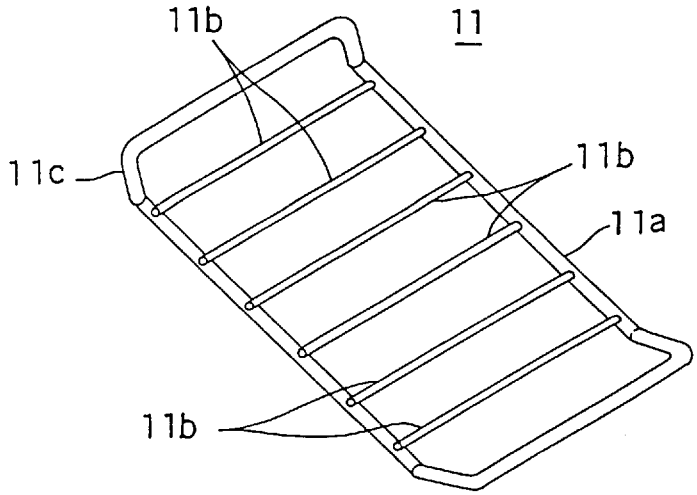
FIG. 12 is a perspective view of the cooking rack used in the broiler oven of the third embodiment.

Reference numeral 2*c* represents cooking rack brackets formed on the inner surfaces of the upper portions of the side walls of the heating chamber 2, near the door la. The cooking rack brackets 2*c* are for placing thereon a grill serving as a cooking rack, as shown in FIG. 12, so that the grill is held in position inside the heating chamber 2. As shown in FIG. 12, the grill 11 is composed of a frame 11*a* made by forming a metal or other wire into a flat rectangular, and a plurality of parallel metal or other beams 11*b* fitted thereto uniformly from above or below at regular intervals so as to bridge between the two longer sides of the rectangular. The frame 11*a* is, near both ends thereof, bent, by the same dimension as the diameter of the beams 11*b*, in the direction from which the beams 11*b* are fitted thereto, and these bent portions are used as support portions 11*c*.

Figure 13:
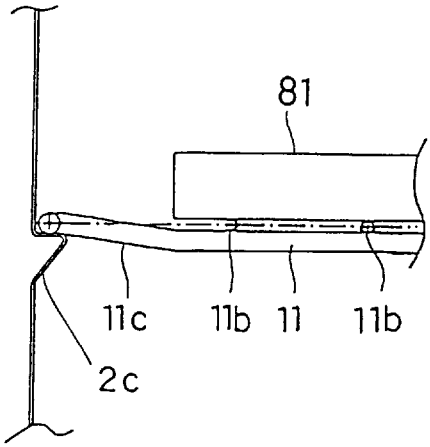
FIG. 13 is a sectional view, as seen from the side, of the principal portion of the cooking rack shown in FIG. 12, in its state placed on the rack bracket of the heating chamber with its beams located below its frame.
Figure 14:
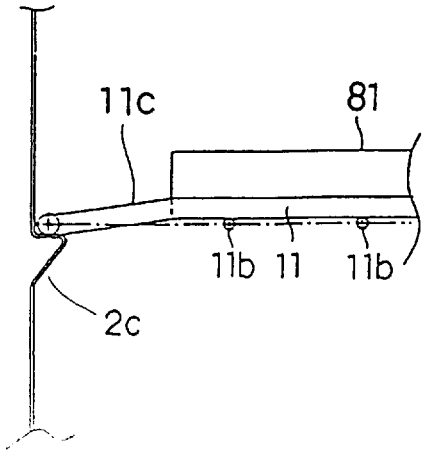
FIG. 14 is a sectional view, as seen from the side, of the principal portion of the cooking rack shown in FIG. 12, in its state placed on the rack bracket of the heating chamber with its beams located above its frame.
Figure 15:
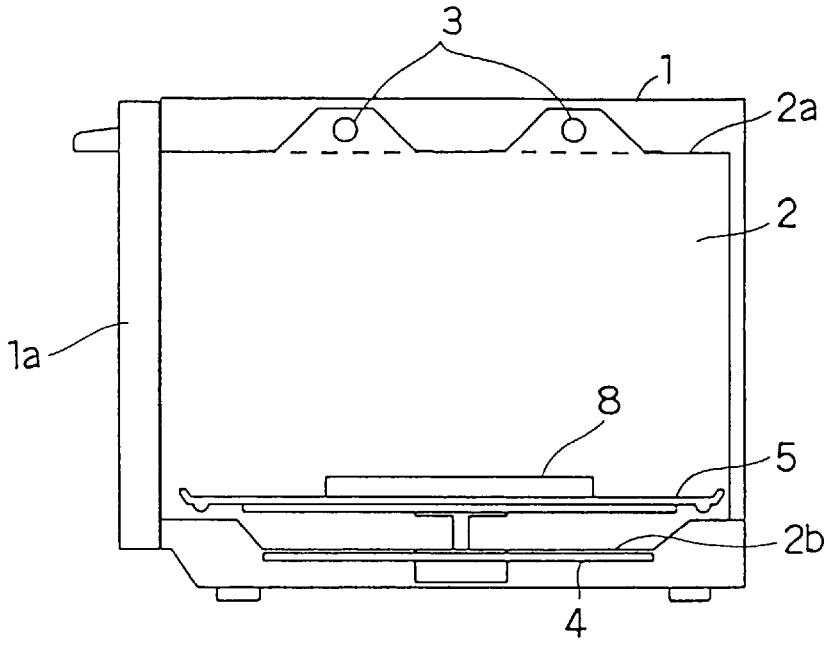
FIG.15 PRIOR ART
FIG. 15 is a sectional view, as seen from the side, of a conventional broiler oven having an upper fixed heater.
Figure 16:
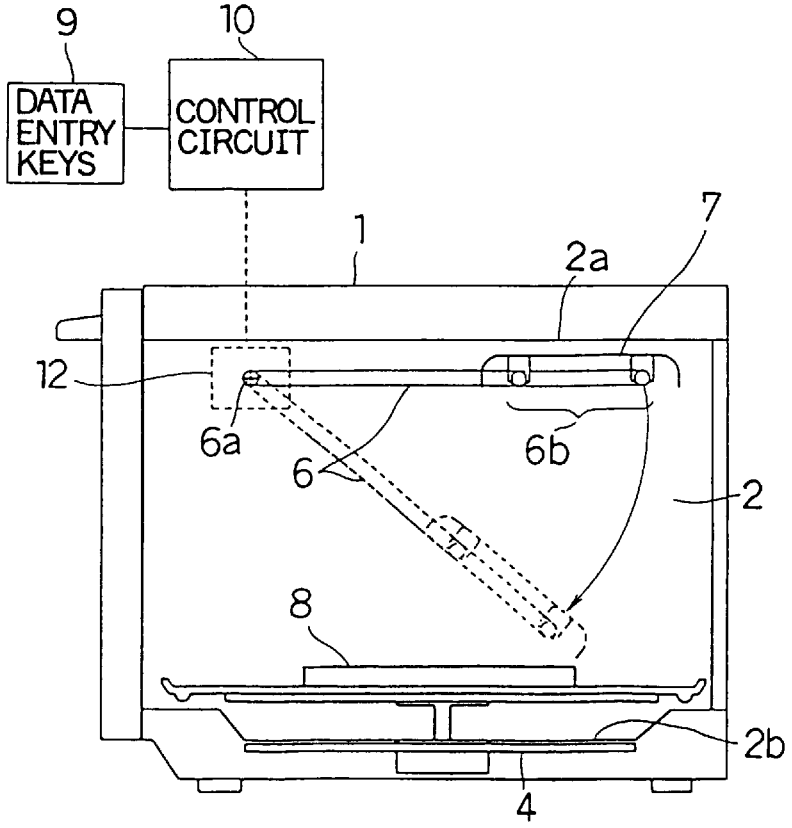
FIG.16 PRIOR ART
FIG. 16 is a sectional view, as seen from the side, of a conventional broiler oven having a movable heater.
Figure 17:
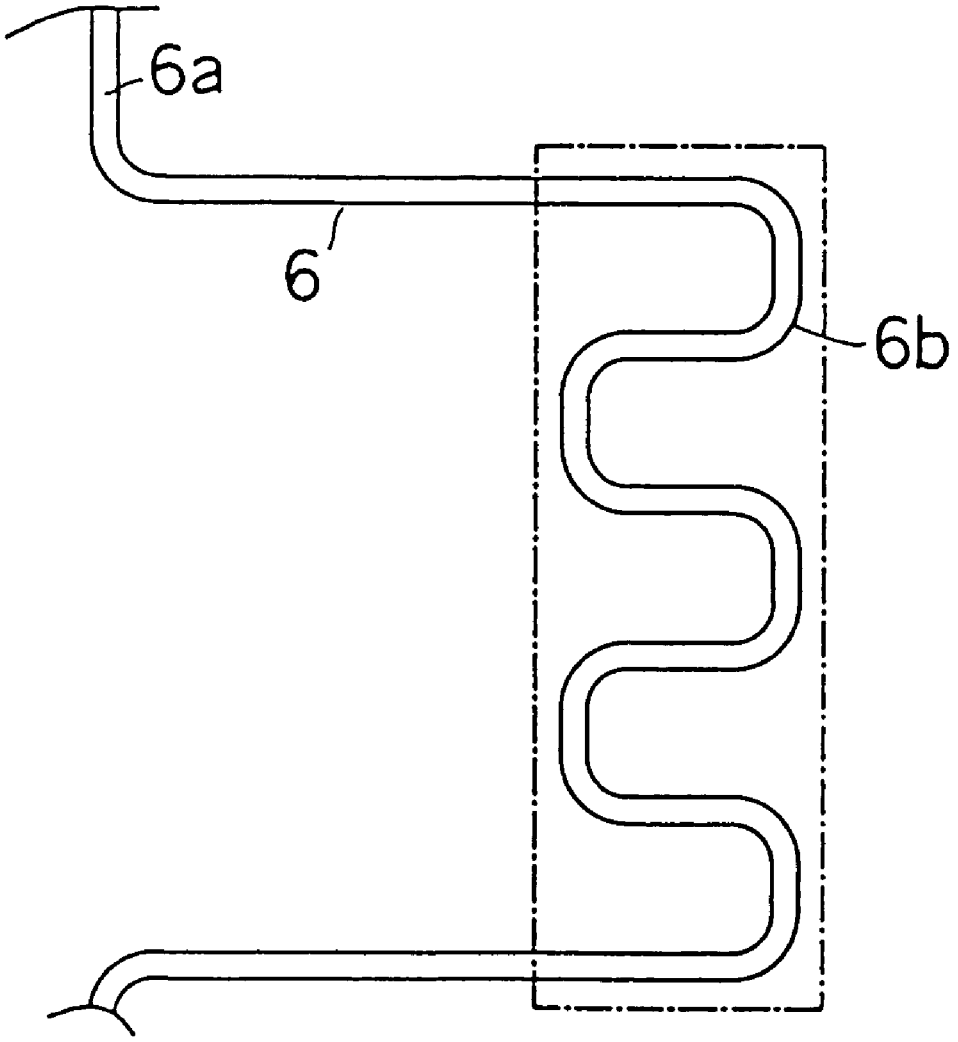
FIG. 17 PRIOR ART
FIG. 17 is a schematic plan view showing the principal portion of the movable heater of the conventional broiler oven shown in FIG. 16.
Figure 18:
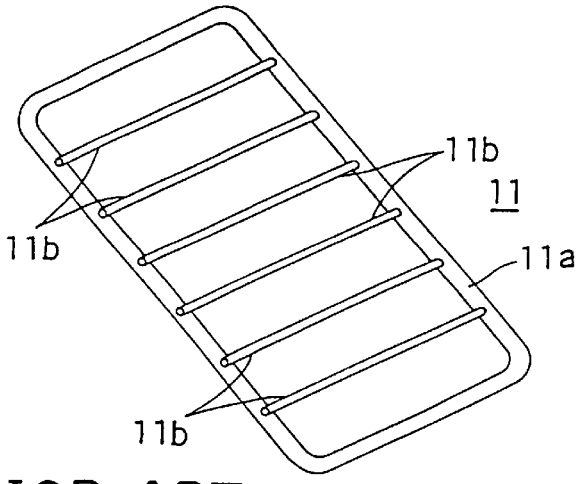
FIG.18 PRIOR ART
FIG. 18 is a perspective view of a conventional grill.
Figure 19:
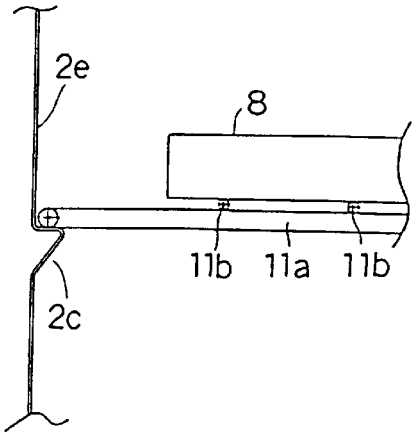
FIG.19 PRIOR ART
FIG. 19 is a sectional view, as seen from the side, of the principal portion of the conventional grill shown in FIG. 18, in its state placed inside the heating chamber with its beams located below its frame.
Figure 20:
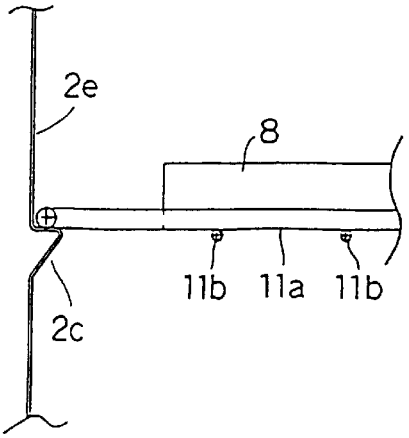
FIG.20 PRIOR ART
FIG. 20 is a sectional view, as seen from the side, of the principal portion of the conventional grill shown in FIG. 18, in its state placed inside the heating chamber with its beams located above its frame.

By forming the grill 11 in this way, it is possible to hold the food to be cooked 81 at a fixed level irrespective of whether the grill 11 is placed on the grill brackets 2*c* of the heating chamber 2 with its beams 11*b* located above its frame 11*a* as shown in FIG. 13 or with its beams 11*b* located below its frame 11*a* as shown in FIG. 14. This makes it possible to keep a fixed distance from the upper fixed heater 3 to the food to be cooked 81, and thereby achieve the same cooking results irrespective of the way the grill 11 is placed.

In this embodiment, when the data entry keys 9 provided on the operation panel 1*b* are operated to instruct the upper fixed heater 3 and the movable heater 63 to start heating, under the control of the control circuit 10, the motor 13 included in the driving mechanism 12 is fed with driving instructions. As a result, the movable heater 63 is rotated through 180 degrees from the non-heating position to the heating position, indicated by broken lines in FIG. 10 (also indicated by (B)), just below the grill 1.

In this structure, when the movable heater 63 is rotated with a comparatively tall food to be cooked 8 placed on the turntable 5, the free end of the movable heater 63 makes contact with the food 8 and causes it to topple down. To prevent this, in this embodiment, as shown in FIG. 10, a weight sensor 22 for detecting the weight of the turntable 5 is provided to make it possible to detect whether food to be cooked 8 is placed on the turntable 5 or not. When the weight sensor 22 detects presence of food 8 on the turntable 5, it feeds the control circuit 10 with a detection signal. As a result, the control circuit 10 stops feeding the driving signal to the motor 13 and thereby prevents the food 8 from toppling down.

Instead of the weight sensor 22, any type of sensor can be used that detects presence of food on the turntable 5 optically, mechanically, or in any other way.

The broiler oven of this embodiment, having the structure as described above, is operated as follows. First, when the movable heater 63 is in the non-heating position, the grill 11 is placed on the cooking rack brackets 2*c*, and food to be cooked 81 is placed on the grill 11. When a predetermined key among the data entry keys 9 that corresponds to what is going to be cooked (such as toast or frozen pizza) is operated, the control circuit 10 feeds the motor 13 of the driving mechanism 12 with a driving signal in accordance with the operated key to drive the motor 13.

At this time, if food to be cooked 8 is placed on the turntable 5, the weight sensor 22 detects the presence of the food 8 and feeds the control circuit 10 with a detection signal. This causes the control circuit 10 to stop feeding the driving signal to the motor 13 regardless of the instructions fed from the data entry keys 9. Then, for example, an alarm indicator 23 (see FIG. 1) provided on the front surface of the operation panel is driven to indicate the presence of food 8 on the turntable 5. This alarm indicator 23 indicates an alarm optically or acoustically.

If there is no food to be cooked 8 on the turntable 5, the control circuit 10 feeds a driving signal to the motor 13, and thus the motor 13 starts rotating. As the motor 13 is driven, its rotation force is transmitted through the pulley 14, the belt 17, the pulley 16, the first reduction gear 15, the second reduction gear 18, and the third reduction gear 19 to the second driving gear 21, and thereby the movable heater 63 is rotated. When the movable heater 63 finishes rotating through 180 degrees from the non-heating position to the heating position (indicated by (B)), the control circuit 10 stops feeding the driving signal to the motor 13, and thus the motor 13 stops rotating.

As a result, the movable heater 63 is positioned in the heating position indicated by broken lines in FIG. 10, i.e. just below the grill 11. The control circuit 10, immediately after it stops feeding the driving signal, feeds a heating signal to the upper fixed heater 3 and the movable heater 63 so that they generate heat and thereby heat the food to be cooked 81 placed on the grill 11.

A predetermined length of time before the end of the heating time required for cooking, the control circuit 10 stops feeding the heating signal to the upper fixed heater 3 and thereby stops heating by the upper fixed heater 3. Thereafter, at the end of the heating time required for cooking, the control circuit 10 stops feeding the heating signal to the movable heater 63 and thereby stops heating by the movable heater 63. Simultaneously, the motor 13 is fed with a reversing signal and is thereby rotated in the reverse direction so that the movable heater 63 is retracted from the heating position (B) to the non-heating position indicated by solid lines. Thus, cooking is finished.

In this embodiment, to perform ordinary grill heating instead of heating of toast or frozen pizza as described above, when the data entry keys 9 on the operation panel are operated in the corresponding manner, in response to such operation of the data entry keys, the control circuit 10 recognizes that ordinary grill heating is requested. Then, the control circuit 10 feeds the motor 13 with a driving signal to rotate the movable heater 63 through 45 degrees (indicated by (A) in FIG. 10) from the non-heating position, and then stops feeding the driving signal.

When ordinary grill heating is requested by operation of the data entry keys, even if the weight sensor 22 feeds the control circuit 10 with a signal indicating that there is food to be cooked 8 on the turntable 5, the control circuit 10 ignores the signal and feeds a driving signal to the motor 13 as described above.

Thereafter, the control circuit 10 feeds a driving signal to the turntable motor 5*a*, and thereby drives the turntable motor 5*a* to rotate the turntable 5. Simultaneously, the control circuit 10 feeds a heating signal to the movable heater 63 to heat the food to be cooked 8. After a predetermined length of time, the control circuit 10 rotates the motor 13 in the reverse direction to retract the movable heater 63 to the non-heating position, and simultaneously de-energizes the turntable motor 5*a* to stop the rotation of the turntable 5.

In this embodiment, it is possible to heat the food to be cooked 81 placed on the cooking rack 11 while keeping the food 81 close to and parallel to the upper fixed heater 3 and the movable heater 63, and thus it is possible to heat the food 81 efficiently and evenly.

What is claimed is:

1. A broiler oven comprising:

a heating chamber for accommodating food to be cooked;

a plurality of tubular heaters arranged inside the heating chamber, the tubular heaters each having a shaft portion, a heating portion parallel to the shaft portion, and an arm portion joining the shaft portion and the heating portion together, the tubular heaters each being rotatable about their respective shaft portion so as to be moved between a resting position and a heating position, the tubular heaters being arranged with their shaft portions supported parallel to one another at an equal level, the tubular heaters having their arm portions made equally long and mutually overlapping, a common driver for rotating the plurality of the tubular heaters;

a controller for controlling heat generated by the tubular heaters; and a linker for interlocking rotation of the tubular heaters by the common driver so as to keep distances between their heating portions constant.

2. A broiler oven as claimed in claim 1, wherein the linker is a reflecting plate that is fitted to the tubular heaters so as to be rotatable with respect to each of the tubular heaters.

3. A broiler oven claimed in claim 1, wherein the plurality of tubular heaters comprise two tubular heaters, and wherein the tubular heaters are each bent near a center of their respective arm portions and are arranged with their bends pointing in opposite directions in such a way that, when the tubular heaters are in the resting position, the shaft portion of the first tubular heater is located near the bend of the arm portion of the second tubular heater and a heating-portion-side portion of the arm portion of the second tubular heater is located near the bend of the arm portion of the first tubular heater, with the shaft portions and the heating portions of the two tubular heaters held substantially at an equal level.

4. A broiler oven comprising:

a heating chamber for accommodating food to be cooked;

a fixed heater provided on a ceiling of the heating chamber;

a movable heater having a shaft portion supported in a portion of the heating chamber near the ceiling thereof and the heating portion rotatable about the shaft portion, the heating portion being rotatable through 180 degrees between a rest position adjacent the fixed heater with respect to the shaft portion and heating position facing the fixed heater;

a supporter for supporting a cooking rack in a position between the fixed heater and the heating position of the movable heater;

a driver for rotating the movable heater; and a controller for controlling heat generated by the fixed heater and the movable heater.

5. A broiler oven as claimed in claim 4, wherein the cooking rack is removable from the supporter and is comprised of a frame that is supported on the supporter at both ends thereof and a plurality of beams that are fixed to the frame uniformly from above or below, the beams being made equally thick and arranged on the frame except at and near both ends thereof, the frame being bent near both ends thereof in a direction from which the beams are fixed thereto in such a way that centers of thickness of both ends of the frame and centers of thickness of the beams all lie on a single plane.

6. A broiler oven claimed in claim 4 and additionally comprising a fixed heater provided beneath a floor of the heating chamber.

7. A broiler oven as claimed in claim 6 and additionally comprising a turntable provided in a region above the floor of the heating chamber adjacent the fixed heater provided thereat.

8. A broiler oven as claimed in claim 7 wherein the turntable is located above the fixed heater provided beneath the floor of the heating chamber.

9. A broiler oven as claimed in claim 8 and additional including a sensor for detecting the presence of an object including food on the turntable, and wherein the controller responds to a signal generated by the sensor for deactivating the driver.

10. A broiler oven as claimed in claim 9 wherein the sensor comprises a weight sensor.

11. A broiler oven as claimed 9 and additionally including a visual and/or acoustic indicator on the oven for indicating the presence of an object including food on the turntable.

12. A broiler oven as claimed in claim 9 wherein the driver comprises an electric motor.

13. A broiler oven comprising:

a heating chamber for accommodating food to be cooked;

a plurality of tubular heaters arranged inside the heating chamber, the tubular heaters each having a shaft portion, a heating portion parallel to the shaft portion, and an arm portion joining the shaft portion and the heating portion together, the tubular heaters each being rotatable about their respective shaft portion so as to be moved between a resting position and a heating position, the tubular heaters being arranged with their shaft portions supported parallel to one another at an equal level, the tubular heaters having their arm portions made equally long and mutually overlapping, and a common driver for rotating the plurality of the tubular heaters.

14. A broiler oven comprising:

a heating chamber for accommodating food to be cooked;

at least two tubular heaters arranged inside the heating chamber, the tubular heaters each having a shaft portion, a heating portion parallel to the shaft portion, and an arm portion joining the shaft portion and the heating portion together, each of the tubular heaters being rotatable about their respective shaft portion so as to be moved between a resting position and a heating position, the tubular heaters being arranged with their shaft portions supported parallel to one another at an equal level, the tubular heaters having their arm portions made equally long and mutually overlapping, a common driver for rotating the tubular heaters;

a controller for controlling heat generated by the tubular heaters;

a linker for interlocking rotation of the tubular heaters by the common driver so as to keep distances between their heating portions constant; and wherein the tubular heaters are each bent near a center of their respective arm portions and are arranged with their bends pointing in opposite directions in such a way that, when the tubular heaters are in the resting position, the shaft portion of the first tubular heater is located near the bend of the arm portion of the second tubular heater and a heating-portion-side portion of the arm portion of the second tubular heater is located near the bend of the arm portion of the first tubular heater, with the shaft portions and the heating portions of the two tubular heaters held substantially at an equal level.

* * * * *